US005583314A

United States Patent [19]

Devaux et al.

[11] Patent Number: 5,583,314

[45] Date of Patent: Dec. 10, 1996

[54] FIRING INDICATOR DEVICE FOR A PROJECTILE, AND RIFLE GRENADE EQUIPPED WITH A FIRING INDICATOR DEVICE

[75] Inventors: Dominique Devaux; René Pinton, both of Bourges; Jean-Michel Loas, La Chapelle Saint Ursin, all of France

[73] Assignee: Luchaire Defense SA, Versailles, France

[21] Appl. No.: 444,931

[22] Filed: May 19, 1995

[30] Foreign Application Priority Data

May 19, 1994 [FR] France ..... 94 06122

[51] Int. Cl.[6] ..... F42B 10/06

[52] U.S. Cl. ..... 102/483; 102/293; 102/372; 102/481

[58] Field of Search ..... 102/293, 372, 102/373, 473, 482–486, 481

[56] References Cited

U.S. PATENT DOCUMENTS

| | | | |
|---|---|---|---|
| 3,176,616 | 4/1965 | Batou | 102/483 |
| 3,188,959 | 6/1965 | Wyser | 102/483 |
| 3,882,780 | 5/1975 | Gawlick et al. | 102/483 |
| 4,389,938 | 6/1983 | Sigrist | 102/481 |

FOREIGN PATENT DOCUMENTS

| | | | |
|---|---|---|---|
| 469795 | 11/1950 | Canada | 102/483 |
| 22331 | 6/1921 | France | 102/482 |
| 2522405 | 2/1982 | France . | |
| 2531204 | 7/1982 | France . | |
| 2583869 | 12/1986 | France . | |
| 2660748 | 4/1990 | France . | |
| 2660747 | 4/1990 | France . | |
| 2637609 | 2/1978 | Germany | 102/373 |
| 3151674 | 7/1983 | Germany . | |
| 379966 | 8/1964 | Switzerland | 102/483 |

*Primary Examiner*—Harold J. Tudor
*Attorney, Agent, or Firm*—Oliff & Berridge

[57] ABSTRACT

A single-use firing indicator device for a projectile having a hollow rear extension includes a stopper and an indicator member. The stopper is shaped to at least partially cover the rear extension of the projectile. The indicator member is connected to the stopper and may secure the firing indicator device to the projectile. Removing the firing indicator device to prepare the projectile for firing requires permanently deforming the indicator member. As a result, the firing indicator device reliably conveys the firing status of the projectile without requiring costly modification or added parts.

16 Claims, 3 Drawing Sheets

FIRING INDICATOR DEVICE FOR A PROJECTILE, AND RIFLE GRENADE EQUIPPED WITH A FIRING INDICATOR DEVICE

BACKGROUND OF THE INVENTION

The present invention relates to a firing indicator device for a projectile, and in particular, to a single-use firing indicator device that can be secured to a rifle grenade.

A firing indicator device displays the firing status of a projectile, i.e., whether or not the projectile has been armed. Under certain circumstances, projectiles do not explode when fired, and thus remain in an armed condition when they reach the ground and are capable of exploding if triggered. As a result, such munitions are dangerous to handle.

A number of devices have been disclosed for displaying the firing status of a projectile to prevent users from handling the projectile while it is still armed. For example, the arming safety device disclosed in French patent 2,583,869 includes a series of small windows made of transparent plastic material through which a rotor having segments of different colors can be viewed. The arming status of the device is determined from the color displayed.

Further, French patent 2,660,747 discloses a projectile having a bullet trap that displays the firing status of the projectile. The bullet trap swells, thereby causing a peg to extend through a bore that is disposed in a radial direction of the sleeve tube.

In addition, a projectile having a device for displaying its firing status that is disposed in its empennage (tail section), as disclosed in French patent 2 660 748, is known. According to a first embodiment, the pressure of the propellant gases perforates a pad placed in an orifice or ejects a peg. According to a second embodiment, the departure of the projectile upon firing causes the sleeve tube to become displaced relative to the empennage, which uncovers a colored band. The ejection of the peg or the appearance of the colored band signals the user that the projectile has already been fired.

In the devices described above, however, machining of or adding parts to the projectile is required, which results in increased costs. In addition, machining orifices in a projectile can lead to a pressure loss, or can make the peripheral part of the bullet trap more fragile and thereby cause a decrease in the reliability of the projectile.

In addition, the display devices of the prior art are relatively small and can therefore be partly concealed by splashed mud, dust, snow, etc. As a result, the reliability of these devices is decreased in many frequently encountered field conditions.

SUMMARY OF THE INVENTION

An object of the present invention is to overcome the disadvantages described above and to provide a firing indicator device for a projectile that shows whether the projectile has been fired without decreasing its reliability.

Another object of the present invention is to provide a firing indicator device specifically designed for a projectile of the rifle grenade type that has a hollow rear extension.

These and other objects are achieved by the firing indicator device of the present invention. The single-use firing indication device for a projectile that has a hollow rear extension includes a stopper and a securing device. The stopper is disposed to at least partially cover the rear extension of the projectile. The securing device is connected to the stopper and secures the firing indicator device to the projectile. Removing the firing indicator device to prepare the projectile for firing requires permanently deforming (e.g., breaking) the securing device.

The securing device can be formed as a single piece with the firing indicator device. The firing indicator device can include two elongate parts that extend away from each other in an unfolded position, the parts being connectable to each other in a folded position with the securing device. The securing device can include pegs and corresponding bores disposed to receive the pegs.

The firing indicator device can be made from plastic material. In addition, the firing indicator device can be molded in the unfolded position. One of the elongate parts of the firing indicator device can include a receptacle dimensioned to receive an azimuth sight.

According to another embodiment, a rifle grenade having a firing indicator device includes a sleeve having an empennage that forms a rear extension. The firing indicator device includes a stopper and a securing device. The stopper is disposed to at least partially cover the rear extension of the rifle grenade. The securing device is connected to the stopper and secures the firing indicator device to the rifle grenade. Removing the firing indicator device to prepare the rifle grenade for firing requires permanently deforming the securing device.

The stopper can be formed as a single piece with two elongated parts that each extend between two adjacent fins of the empennage. The two elongated parts are secured to one another around the sleeve by the securing device.

Because the firing indicator device of the present invention does not function after a single use, potentially life-threatening injuries caused by a user's unintended handling of an armed projectile are avoided. In addition, because the firing indicator device at least partially covers the rear extension, the firing indicator device prevents the interior of the projectile from becoming wet or otherwise fouled.

BRIEF DESCRIPTION OF DRAWINGS

A complete understanding of the present invention may be obtained by reference to the accompanying drawings, when considered in conjunction with the subsequent detailed description thereof, in which.

DETAILED DESCRIPTION OF PREFERRED EMBODIMENTS

Figure 1:
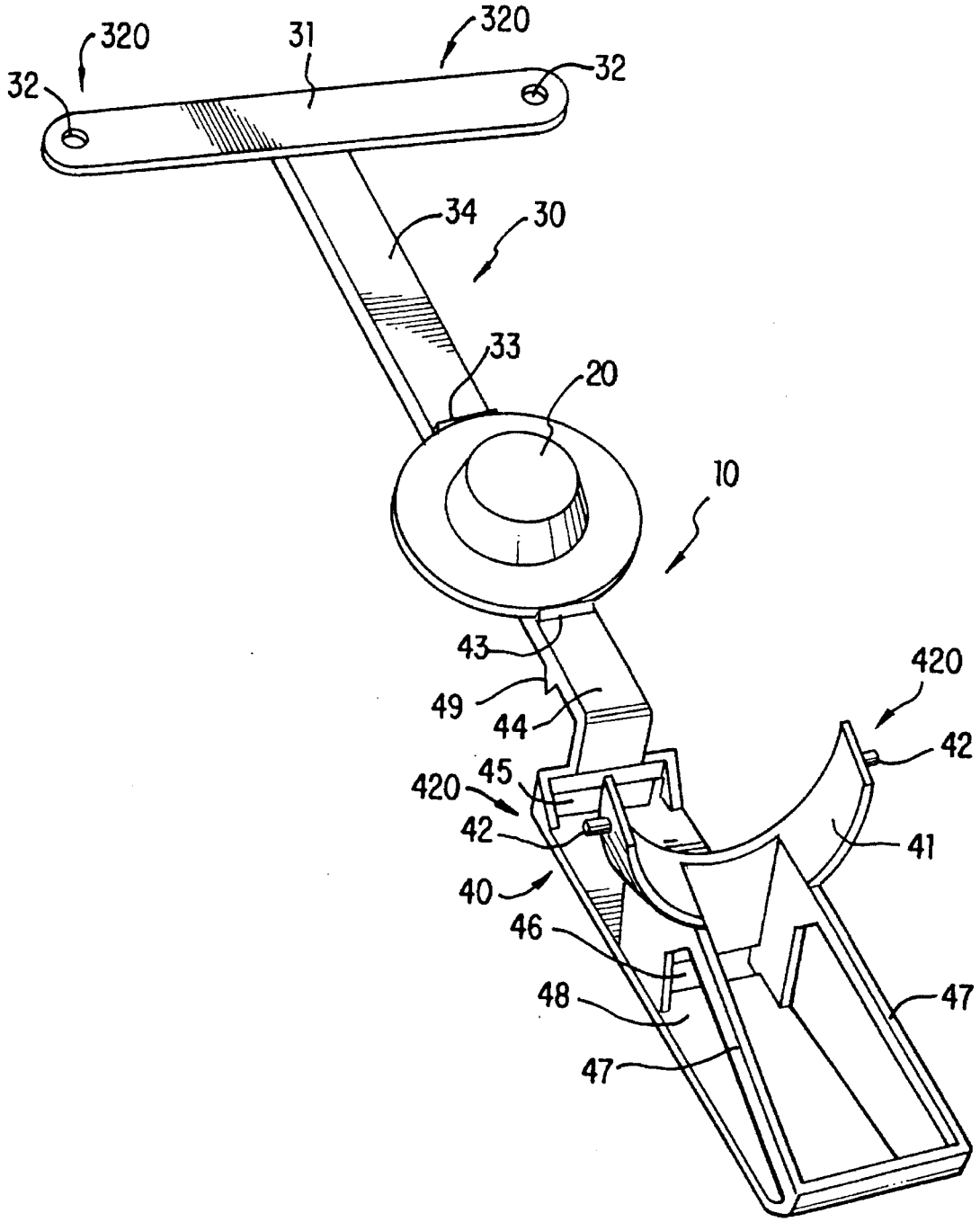
FIG. 1 is a pictorial view of a firing indicator device according to the present invention.

As shown in FIG. 1, the firing indicator device according to an embodiment of the present invention includes a stopper 20 that is designed to at least partially cover the hollow rear extension of a projectile. This stopper 20 is formed as a single piece with two elongate parts 30, 40 that extend away from each other when the device is in an unfolded position. The two elongate parts 30, 40 are designed to be connected to each other in a folded position by a securing means. These two elongate parts 30, 40 are respectively joined to the stopper 20 by hinges 33, 43 that are produced by thinning each elongate part 30, 40. The hinges allow the device to be manipulated between its unfolded and folded positions.

The first elongate part 30 includes a substantially rectilinear portion 34 connected to one end of the stopper 20 by the hinge 33. The other end of the rectilinear portion 34 is formed as a single piece with a transverse portion 31 having a first securing means 320 that extends substantially perpendicular to the rectilinear portion 34.

The second elongate part 40 also includes a substantially rectilinear portion 44 connected at one of its ends to the stopper 20 by the hinge 43. The other end of this rectilinear portion 44 is bent back and is formed as a single piece with a tab 48. A curved portion 41 having a radius of curvature that substantially corresponds to the outer circumference of a sleeve tube of a projectile is mounted on and disposed substantially perpendicular to the tab 48.

Figure 4:
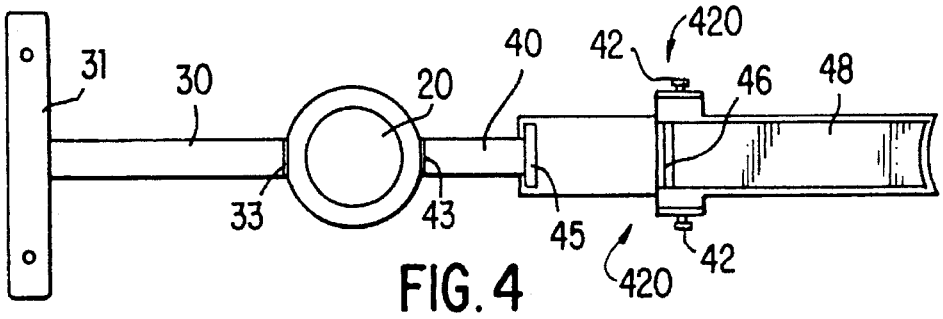
FIG. 4 is a top view of the firing indicator device.
Figure 5:
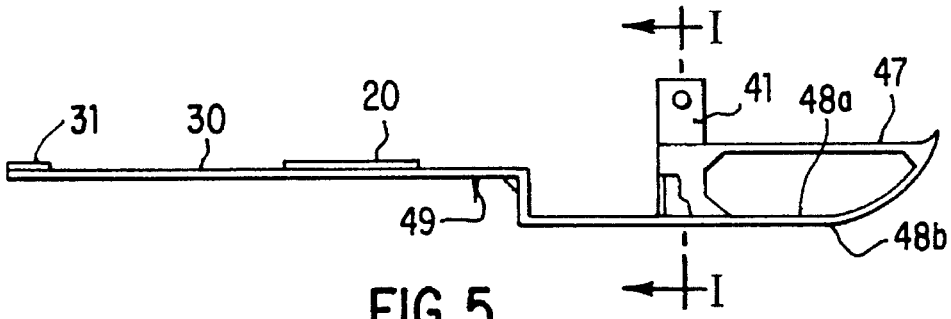
FIG. 5 is a front view of the device of FIG. 4.

As depicted in FIGS. 4 and 5, the curved portion 41 is elevated with respect to an inner surface 48*a* of the tab 48. A second end of the tab, which is opposite a first end that adjoins the rectilinear portion 44, curves inward. Connecting elements 47 join this second end of the tab 48 to the curved portion 41, thereby forming a handle. The curved portion 41 includes a second securing means 420 disposed to complement a first securing means 320.

The securing means 320, 420 are integral with the firing indicator. They are designed to attach the firing indicator device to the projectile securely, yet allow the device to be detached from the projectile when opened. The securing means 320, 420 operate in an irreversible manner, i.e., they permit the firing device to be attached once, but after the device is detached, the securing means permanently deforms (e.g., by breaking) and thus no longer functions. As a result, the firing indicator device of the present invention can be used for only a single use.

Figure 6:
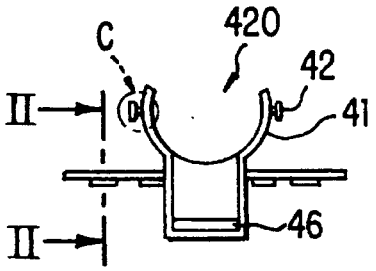
FIG. 6 is a sectional view along line I—I of FIG. 5.
Figure 7:
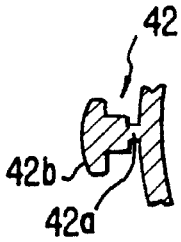
FIG. 7 is an enlarged sectional view of detail C of FIG. 6.
Figure 8:
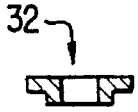
FIG. 8 is an enlarged sectional view along line II—II in FIG. 6.

As shown in FIGS. 6–8, the securing means 320, 420 include pegs 42 and complementary bores 32 designed to receive the pegs 42. Each of the pegs 42 includes an enlarged part 42*b* having a dimension greater than a diameter of the bore 32. These pegs 42 are formed as a single piece with the curved portion 41. A part 42*a*, which has a small dimension and thus can be easily sheared, ensures that the securing means functions for only a single use.

The firing indicator device is made of plastic, preferably by molding. In a preferred embodiment, the device is molded as a single piece in the unfolded position as shown in FIG. 1. As a result of fabricating the firing indicator device in an unfolded position, any attempt to reinstall a spent device is more difficult because the residual elasticity of the plastic material tends to return the firing indicator device to its initial unfolded position.

Figure 9:
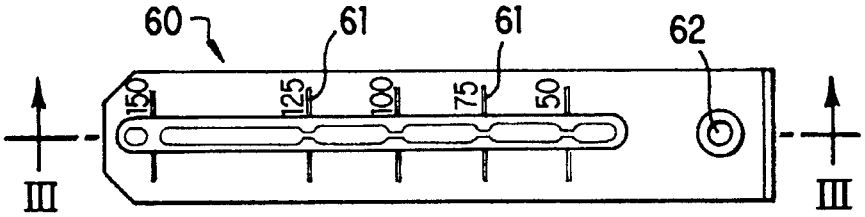
FIG. 9 is a top view of an azimuth sight.
Figure 10:
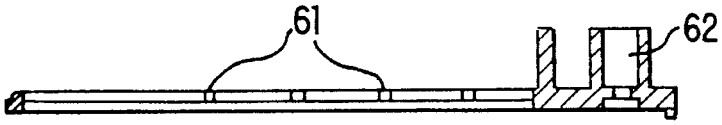
FIG. 10 is a sectional view along line III—III in FIG. 9.

In another embodiment, the elongate part 40 is dimensioned to receive an azimuth sight 60, as shown in FIGS. 9 and 10. As is known, the azimuth sight 60 includes the fastening means 62 that allows the azimuth sight to be mounted on a weapon and graduations 61 that provide the user with information about the firing angle of the projectile.

The receptacle for the azimuth sight 60 is formed by openings 45, 46 that are disposed at the point where the tab 48 joins the rectilinear portion 44 and beneath the curved portion 41, respectively. The azimuth sight 60 can therefore be slid through the openings 45, 46 over the tab 48 adjacent the inner surface 48*a* of the tab 48. A projection 49 formed on the rectilinear portion 44 creates a stop, thus preventing the azimuth sight 60 from sliding out of the receptacle.

Figure 2:
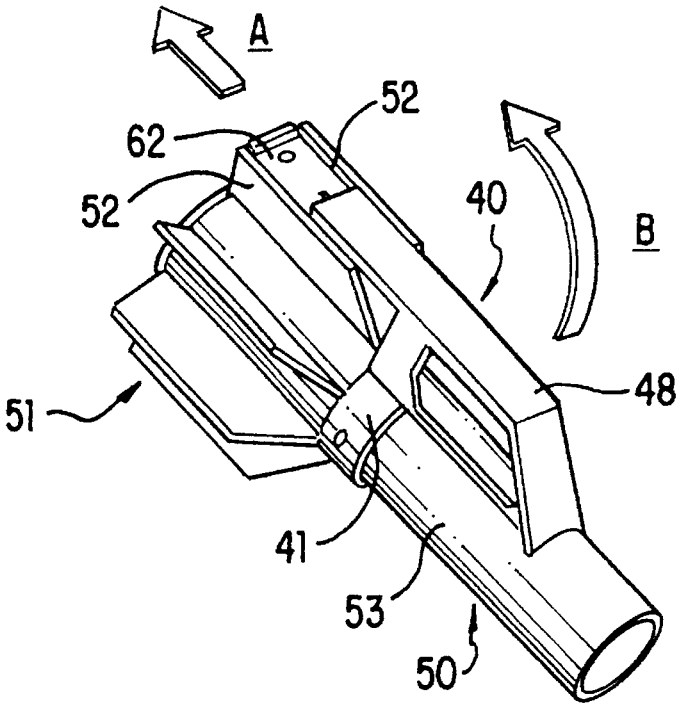
FIG. 2 is a pictorial view of a rifle grenade according to the invention.
Figure 3:
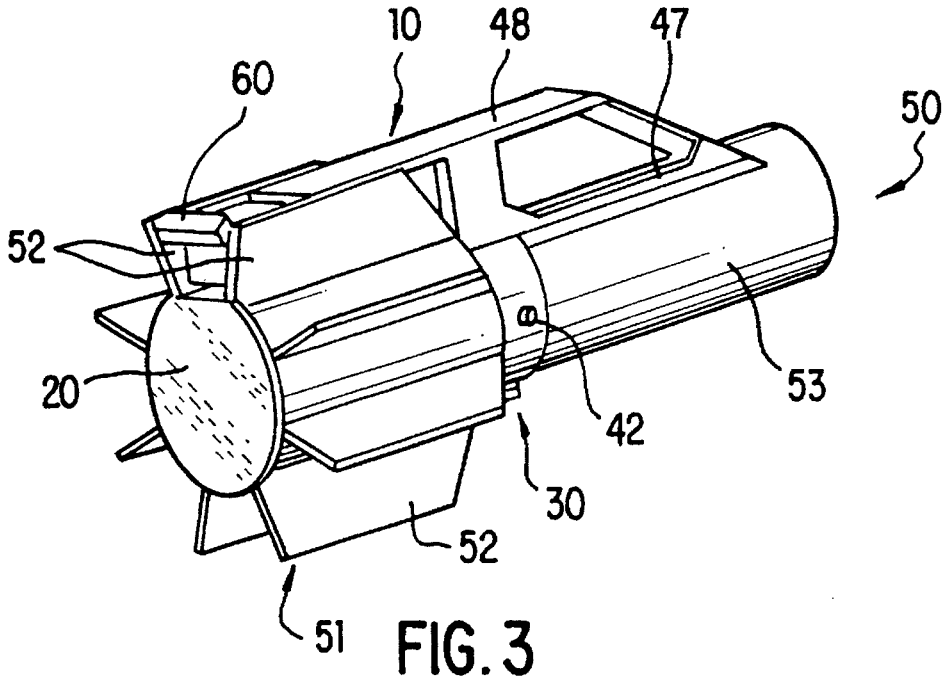
FIG. 3 is a pictorial view, from another angle, of the rifle grenade of FIG. 2.

FIGS. 2 and 3 show a firing indicator device mounted on a rifle grenade. The rifle grenade 50 has a sleeve tube 53 having an empennage 51 that forms a rear extension. Each elongate part 30, 40 of the firing indicator extends between two adjacent fins 52 of the empennage 51. The firing indicator device is mounted by folding it around the sleeve tube 53 of the rifle grenade and securing the elongate parts 30, 40 to each other by securing means 320, 420.

When mounted, the curved portion 47 of the firing indicator device surrounds half of the circumference of the sleeve tube 53. The transverse portion 31 is positioned to face the curved portion 41 and to surround the other half of the circumference of the sleeve tube 53. The ends of the transverse portion 31, which include the bores 32, cover the ends of the curved portion 41 so as to align the bores 32 and the pegs 42, thus allowing the firing indicator device 10 to be secured around the rifle grenade 50. As a result, the present invention can be used without changing or adding parts to the rifle grenade.

In operation, the user first removes the azimuth sight 60 by moving it in the direction of arrow A as shown in FIG. 2. The user then pulls the tab 48 in the direction of arrow B so as to break the securing means 320, 420 at the weakened part 42*a* of pegs 42. The rifle grenade is then placed on the barrel of the weapon for firing. Because the securing means 320, 420 are destroyed, it is impossible for the user to reposition the firing indicator device on the rifle grenade. Consequently, because already-fired rifle grenades can be readily recognized, any unfired rifle grenade not having a firing indicator device will be considered dangerous and likely to be armed.

Although this invention is described in conjunction with specific embodiments thereof, many alternatives, modifications and variations will be apparent to those skilled in the art. Accordingly, the preferred embodiments of the invention as set forth above are intended to be illustrative, not limiting. Various changes to the invention may be made without departing from its true spirit and scope as defined in the following claims.

What is claimed is:

1. A single-use firing indicator device for a rifle grenade having a hollow rear extension adapted to be mounted on an end of a barrel of a rifle, said firing indicator device comprising:

a stopper shaped to at least partially cover said rear extension of said rifle grenade; and two elongate portions that extend away from each other in an unfolded position on opposite sides of said stopper, said two elongate portions being connectable to each other in a folded position, said two elongate portions including securing means for securing said firing indicator device to said rifle grenade, wherein removal of said firing indicator device from said rifle grenade permanently deforms said securing means.

2. The single-use firing indicator device of claim 1, wherein said two elongate portions are one piece with said stopper.

3. The firing indicator device of claim 1, wherein said firing indicator device is made of a plastic material molded in said unfolded position.

4. The firing indicator device of claim 1, wherein said elongate portions include a receptacle dimensioned to receive an azimuth sight.

5. The firing indicator device of claim 1, wherein said securing means includes pegs and corresponding bores dimensioned to receive said pegs.

6. The firing indicator device of claim 1, wherein said firing indicator device is made of a plastic material.

7. The firing indicator device of claim 1, wherein said elongate portions are connected to said stopper and have a receptacle dimensioned to received an azimuth sight.

8. A rifle grenade having a firing indicator device secured thereto, said rifle grenade having a hollow rear extension adapted to be mounted on an end of a barrel of a rifle, said firing indicator device comprising:

a stopper shaped to at least partially cover said rear extension of said rifle grenade; and two elongate portions that extend away from each other in an unfolded position on opposite sides of said stopper, said two elongate portions being connectable to each other in a folded position, said two elongate portions including securing means for securing said firing indicator device to said rifle grenade, wherein removal of said firing indicator device from said rifle grenade permanently deforms said securing means.

9. The rifle grenade of claim 8, wherein said two elongate portions are one piece with said stopper.

10. The rifle grenade of claim 8, wherein said firing indicator device is made of a plastic material molded in said unfolded position.

11. The rifle grenade of claim 8, wherein said elongate portions include a receptacle dimensioned to receive an azimuth sight.

12. The rifle grenade of claim 8, wherein said securing means includes pegs and corresponding bores dimensioned to receive said pegs.

13. The rifle grenade of claim 8, wherein said firing indicator device is made of a plastic material.

14. The rifle grenade of claim 8, wherein said two elongate portions are connected to said stopper and have a receptacle dimensioned to receive an azimuth sight.

15. The rifle grenade of claim 8, wherein said rifle grenade includes a sleeve tube with an empennage having fins that forms said rear extension, and wherein said stopper is formed as a single piece with said two elongate portions, each of said two elongate portions extending between adjacent fins attached to said rear extension.

16. A method of indicating a firing status of a rifle grenade having a hollow rear extension adapted to be mounted on an end of a barrel of a rifle, comprising:

at least partially covering the rear extension of said rifle grenade with a stopper operatively connected to two elongate portions that extend away from each other in an unfolded position on opposite sides of said stopper, said two elongate portions being connectable to each other in a folded position; and fastening said stopper to said rifle grenade with securing means at said elongate portions in such a manner that removing said stopper from said rifle grenade to prepare said rifle grenade for firing permanently deforms said securing means.

* * * * *